US007441288B2

(12) United States Patent
Johnson et al.

(10) Patent No.: US 7,441,288 B2
(45) Date of Patent: Oct. 28, 2008

(54) FITTED BLANKET

(76) Inventors: Yvonne Johnson, 2 Drumlins Ter., Syracuse, NY (US) 13224; Tunisia Johnson, 2 Drumlins Ter., Syracuse, NY (US) 13224

( * ) Notice: Subject to any disclaimer, the term of this patent is extended or adjusted under 35 U.S.C. 154(b) by 6 days.

(21) Appl. No.: 11/403,028

(22) Filed: Apr. 12, 2006

(65) Prior Publication Data

US 2007/0240262 A1 Oct. 18, 2007

(51) Int. Cl.
*A47G 9/00* (2006.01)

(52) U.S. Cl. ..... 5/485

(58) Field of Classification Search ..... 5/485, 5/498

See application file for complete search history.

(56) References Cited

U.S. PATENT DOCUMENTS 1,865,329 A 6/1932 McHorter
3,654,646 A 4/1972 McMahon, Jr. ..... 5/334 C
3,824,640 A 7/1974 Golden ..... 5/334 C
3,996,633 A * 12/1976 Burke ..... 5/497
4,344,196 A * 8/1982 Large ..... 5/496
6,134,730 A * 10/2000 Evanson ..... 5/482
6,502,258 B1 * 1/2003 Mitchell ..... 5/497

* cited by examiner

*Primary Examiner*—Patricia Engle
*Assistant Examiner*—William Kelleher
(74) *Attorney, Agent, or Firm*—Bernhard P. Molldrem, Jr.

(57) ABSTRACT

A fitted blanket has a generally rectangular pocket member attached at its foot end to fit over the foot of the bed mattress. The pocket member is formed of a fabric, e.g., flannel, and has top, side, bottom and back panels, with the top panel having a length dimension of about twelve to twenty-four inches. The side panels have forward edges that extend diagonally from the bottom panel to the top panel Elastic extends around the pocket member is joined to the blanket portion at a seam sewn across the front edge of the top panel. The deep pocket member of this design accommodates in comfort the feet of a sleeper in the bed and also resists being pulled or kicked off the bed.

8 Claims, 2 Drawing Sheets

FITTED BLANKET

BACKGROUND OF THE INVENTION

This invention is directed a blanket that is used as a bed covering to keep a sleeper or sleepers warm and comfortable while sleeping. The invention is also directed to a fitted covering of that type that facilitates making up the bed and which also avoids having the sleeper inadvertently kick the covers off the bed while sleeping.

Fitted bed sheets, especially fitted bottom sheets, have become quite common to facilitate making up the bed after a night's sleep or when changing the bed covers. A number of proposals have been made also for fitted top sheets, in which a pocket is formed at the foot end of the sheet, and is intended to fit over the foot end of the mattress. Some examples of these are found, for example, in Mitchell U.S. Pat. No. 6,502,258; and McMahon Jr. U.S. Pat. No. 3,654,646. Other proposals for fitted combination bed coverings are found in Evanson U.S. Pat. No. 6,134,730; Golden U.S. Pat. No. 3,824,640; and McHorter U.S. Pat. No. 1,865,329. Some of these involve a generally rectangular "pocket" member sewn or otherwise formed at one end of the bed cover, with the pocket fitting around and under the foot end of the mattress to hold the item in place. However, these have all had rather short pocket member, i.e., extending only a few inches from the end of the mattress. If used as a top cover, i.e., a blanket, there is insufficient holding power to keep the sleeper from kicking the cover off the bed if he or she tosses or turns in the night. Also, for tall persons whose feet reach the end or nearly to the end of the bed, these earlier designs do not accommodate the person's feet if he or she attempts to reach the foot end of the bed. In addition, the blanket portion is not fastened or sewn to the pocket portion across the top edge of the pocket, and instead is sewn on an end or bottom panel of the pocket. This does not provide sufficient resistance to pushing the blanket off the bed.

OBJECTS AND SUMMARY OF THE INVENTION

Accordingly, it is an object of this invention to provide a simple and effective design for a bed cover, i.e., blanket, that fits onto the foot end of the bed and avoids the drawbacks inherent in the prior art.

It is another object to provide a fitted blanket that accommodates the feet of sleepers tall enough to reach the foot of the bed while sleeping, and which does not pull off or kick off due to motion of the sleeper in the bed.

It is a further object to provide a blanket that has a natural appearance when on the bed, and facilitates making up the bed after the person has arisen.

According to one aspect of this invention, a fitted blanket is made of a suitable length and width to fit over a foot end of a standard bed mattress. The mattress has a lengthwise dimension from the head to the foot of the bed, and has a width or transverse dimension extending the left to the right side. The fitted blanket has a generally rectangular blanket portion of a suitable material (e.g., wool, wool blend, or synthetic cloth) its length dimension is sufficiently long to cover a sleeper lying on the mattress and to drape over the foot end of the bed. The blanket portion also is wide enough to cover the sleeper and to drape over the sides of the bed mattress. As means for fitting the blanket onto the mattress, there is a pocket member at the foot end, formed of a durable flexible cloth material (e.g., flannel) and of a generally box shape, i.e., formed of a rectangular top panel, trapezoidal or triangular side panels, a rectangular back panel, and a generally rectangular bottom panel, leaving an open mouth formed at front edges of said top, bottom and side panels. In order to ensure that the blanket does not easily pull off the bed during the night. The top panel has a length dimension of between 12 and 24 inches, preferably about 18 inches. The diagonals of the side panels extend to this line. The bottom panel is deep enough, e.g., about three to six inches, to fig the mattress foot end over the bed sheets plus any other coverings. An elastic member is sewn along the front edges of the left and right side panels and extends along the front edge of the bottom panel. This holds the pocket in place over the foot end of the bed mattress. The pocket member and blanket portion are joined at a seam line, where the seam is sewn at a line adjacent the front edge of the top panel of the pocket member. The seam extends across the top panel and joins the blanket portion to the pocket member.

The elastic member can be an elastic band that extends all the way across the front edge of bottom panel, as well as up the diagonal front edges of the side panels to the top panel. Favorably, the top panel of the pocket member has a width dimension substantially the same as the transverse dimension of the bed mattress.

The above and many other objects, features, and advantages of this invention will present themselves to persons skilled in this art from the ensuing description of preferred embodiments of this invention, as described with reference to the accompanying Drawing.

DETAILED DESCRIPTION OF THE PREFERRED EMBODIMENT(S)

Figure 1:
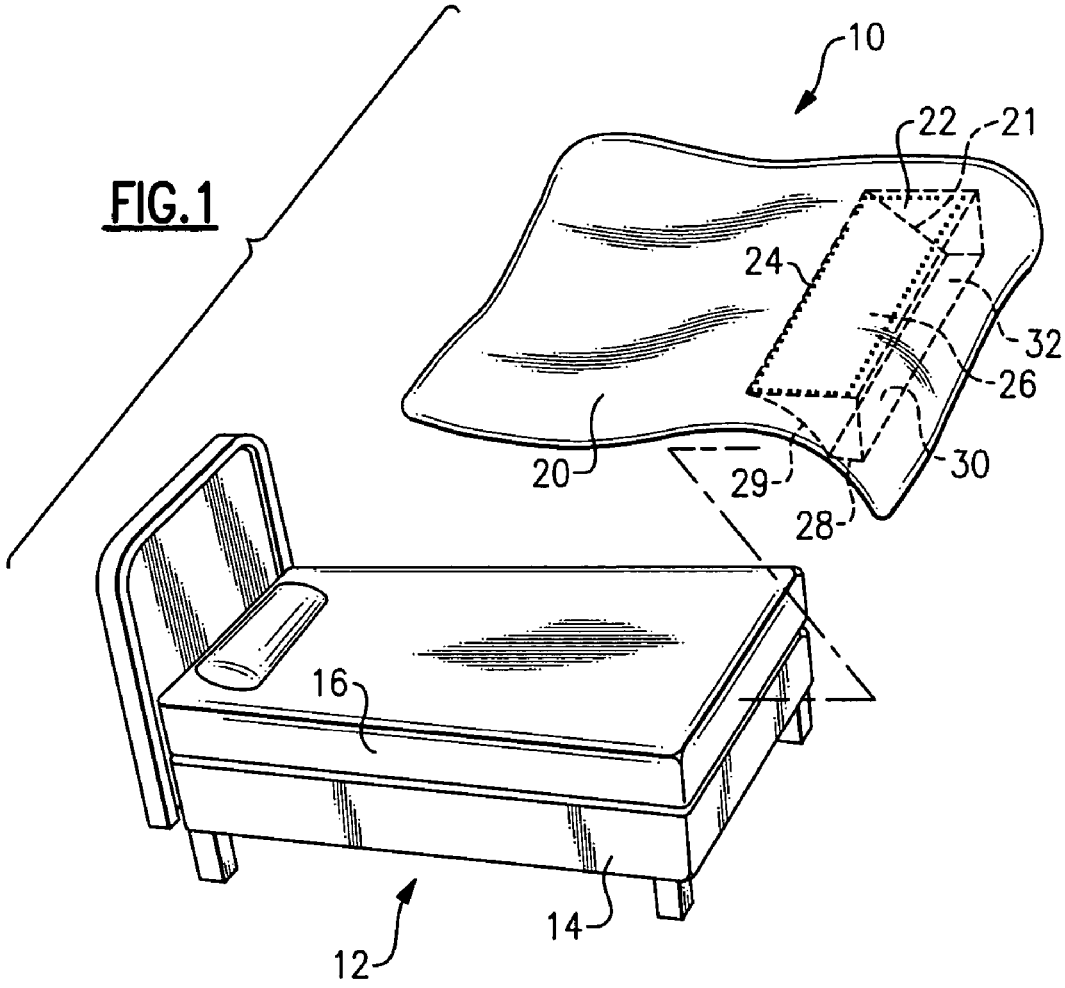
FIG. 1 is a perspective view of a bed and a fitted blanket according to an embodiment of this invention.

With reference to the Drawing, FIG. 1 shows an embodiment of the fitted blanket 10 of the present invention in conjunction with a standard bed 12, of the type having a frame and box spring 14 supporting a mattress 16. A mattress pad, a bottom sheet and a top sheet are present on the mattress 16 and the blanket 10 is laid over these as an outer bed covering. A top cover, not shown, may be placed over the blanket.

The blanket 10 has a main blanket portion 20, which is generally a rectangular piece of a warm, flexible and comfortable fabric, which may be of any of a number of well known types. The main blanket portion is sufficiently long so that its foot end drapes over the foot end of the mattress and is sufficiently wide so that the edges drape down over the left and right side edges of the bed. The blanket may come in a size appropriate for the particular bed 10 or mattress 16, i.e., child size, twin, double, queen, or king.

A short distance from the foot end of the blanket portion 20, there is a generally box-shaped pocket member 22 that is sewn to the blanket portion 20 along a transverse seam 24. The pocket member 22 has a top panel 26, left and right side panels 28, a bottom panel 30 and a back panel 32. The top and bottom panels have generally rectangular shapes, but the top panel 26 extends significantly farther along the forward direction than does the lower panel. The side panels 28 are then of an angulated shape, e.g., trapezoidal, and each has a diagonal forward edge 29, as shown. The front end of the pocket member 22 is open, and is formed as a mouth surrounded by the front edges of the panels 26, 28, 28, and 30 to fit over the foot end of the mattress 16. The term "panel" is used here as a convenience in explanation, and in practice the pocket member 22 would be made from a single piece of fabric.

Figure 2:
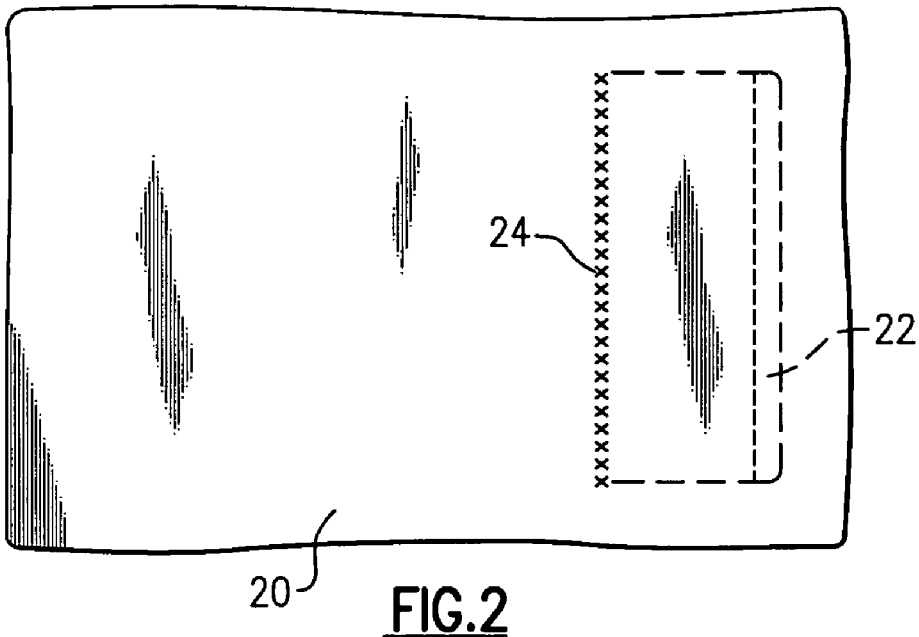
FIG. 2 is a top plan view of the fitted blanket of this embodiment.
Figure 3:
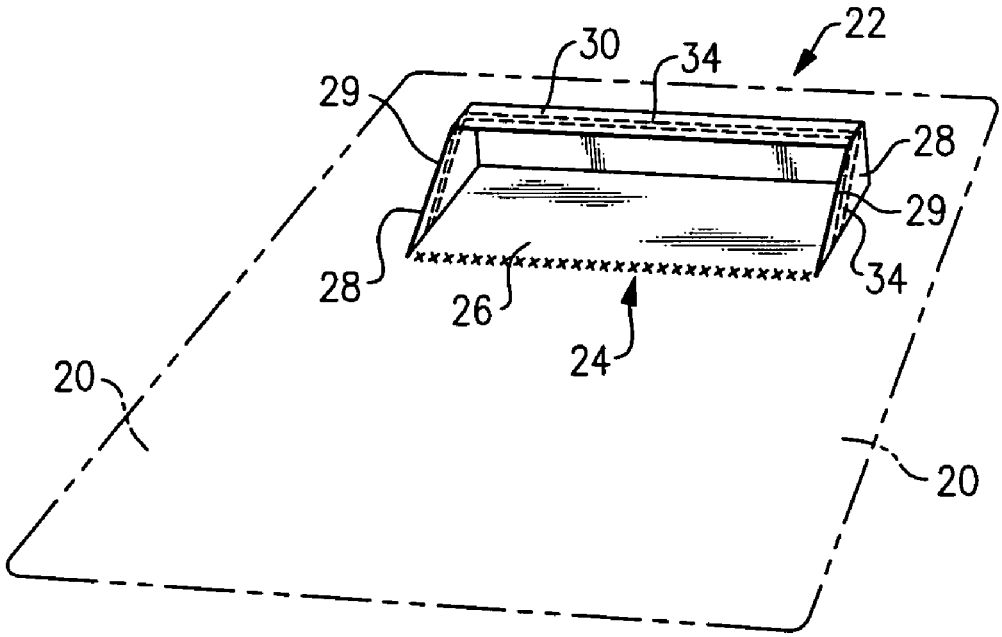
FIG. 3 is a bottom perspective view of this embodiment.

FIGS. 2 and 3 also illustrate the fitted blanket 10 of this embodiment. The seam 24 is shown extending across the top panel 26 from one side edge to the other along or adjacent to its front edge. Also, there is an elastic band 34 that is sewn into the side panels 28 and the bottom panel 30 at their front edges to hold the pocket in place on the mattress. The elastic band should extend at least partway across the bottom panel 30, and preferably, as shown here, should extend all the way across it, as well as extend along the diagonal edges 29 of the side panels 28.

As shown here, the seam 24 is positioned about a quarter to a third of the distance from the foot end of the blanket portion 20. It has been found that with the seam at this location, and about one and one half feet from the foot of the mattress, the pocket member 22 is sufficiently deep (at the blanket side) that it can accommodate the sleepers feet, which can slide under the seam into the pocket, and provide normal comfort. At the same time, the pocket member 22 remains in place on the mattress even when the sleeper tosses and turns during the night.

The pocket member 22 should be formed of a durable, comfortable fabric. In a preferred implementation, flannel is used.

While not shown here, there may be a decorative fabric strip across the blanket covering the seam 24.

While the invention has been described and illustrated in respect to a selected preferred embodiment, it should be appreciated that the invention is not limited only to that precise embodiment. Rather, many modifications and variations would present themselves to those of skill in the art without departing from the scope and spirit of this invention, as defined in the appended claims.

We claim:

1. A fitted top blanket adapted to fit over a foot end of a bed mattress, the mattress having a lengthwise dimension extending from a head end to said foot end thereof and having a transverse dimension extending from a left side to a right side thereof, the fitted blanket comprising a blanket portion formed generally as a rectangle of a suitable material with a head end and a foot end opposite the head end, the blanket portion having a length dimension sufficient to cover a sleeper on said mattress and to drape over the foot end of the bed mattress and having a width dimension sufficient to cover the sleeper and to drape over the sides of the bed mattress;

a pocket member of a durable flexible cloth material disposed near the foot end of the blanket portion and formed of a rectangular top panel, side panels, a rectangular back panel, and a rectangular bottom panel, leaving an open mouth formed at front edges of said top, bottom and side panels, the mouth opening generally toward the head end of the blanket portion, the top panel having a length dimension of between 12 and 24 inches, the bottom panel having a length dimension of about three to six inches, and the side panels each having a diagonal front edge that slopes up towards the head end of the blanket portion;

an elastic member sewn along the diagonal front edges of the left and right side panels and extending along the entire front edge of the bottom panel and for the entire length of said diagonal front edges to hold said pocket in place over the foot end of the bed mattress; and a transverse seam sewn transversely through the blanket portion and through the pocket member at a line adjacent the front edge of the top panel of the pocket member, such that said pocket member is joined to said blanket portion at said transverse sewn seam and with said seam extending thereacross, joining the blanket portion directly to the pocket member, such that the pocket is sufficiently deep that it can accommodate the sleeper's feet to permit the sleepers's feet to slide under the transverse seam and into the pocket under said top panel, and with the blanket providing normal comfort.

2. A fitted blanket according to claim 1 wherein said sewn seam extends across said blanket portion about eighteen inches from the back edge of said top panel.

3. A fitted blanket according to claim 1 wherein said elastic member includes an elastic band extending across the entire front edge of said bottom panel.

4. A fitted blanket according to claim 1 wherein said pocket member is formed of a flannel material.

5. A fitted blanket according to claim 1 wherein the top panel of said pocket member has a width dimension substantially the same as the transverse dimension of said bed mattress.

6. A fitted blanket according to claim 1 wherein said transverse sewn seam is positioned between a quarter and a third the distance from the foot end of the blanket to the head end thereof.

7. The fitted blanket according to claim 1 wherein the diagonal front edge of each side panel is curved.

8. A fitted blanket adapted to fit over a foot end of a bed mattress, the mattress having a lengthwise dimension extending from a head end to said foot end thereof, and having a transverse dimension extending from a left side to a right side thereof, the fitted blanket comprising:

a blanket portion formed generally as a rectangle of a suitable material with a head end and a foot end opposite the head end, the blanket portion having a length dimension sufficient to cover a sleeper on said mattress and to drape over the foot end of the bed mattress and having a width dimension sufficient to cover the sleeper and to drape over the sides of the bed mattress;

a pocket member of a durable flexible cloth material near the foot end of the blanket portion and formed of a rectangular top panel, side panels, a rectangular back panel, and a rectangular bottom panel, leaving an open mouth formed at front edges of said top, bottom and side panels, the mouth opening generally toward the head end of the blanket portion, the top panel having a length dimension of between 12 and 24 inches, the bottom panel having length dimension of about three to six inches, and the side panels each having a diagonal, curved front edge that slopes up towards the head end of the blanket portion, wherein the pocket member is in the form of a unitary piece of fabric;

an elastic member sewn along the diagonal front edges of the left and right side panels and extending along the entire front edge of the bottom panel and for the entire length of said diagonal front edges to hold said pocket in place over the foot end of the bed mattress; and a transverse seam sewn transversely through the blanket portion and through the pocket member at a line adjacent the front edge of the top panel of the pocket member and extending thereacross, joining the blanket portion directly to the pocket member at the mouth of said pocket member at said transverse seam; such that the pocket is sufficiently deep that it can accommodate the sleeper's feet to permit the sleepers's feet to slide under the transverse seam and into the pocket under said top panel, and with the blanket providing normal comfort.

* * * * *